US009228268B2

(12) United States Patent
Zhang-Berlinger et al.

(10) Patent No.: US 9,228,268 B2
(45) Date of Patent: Jan. 5, 2016

(54) METHOD OF ELECTROPLATING SILVER STRIKE OVER NICKEL

(75) Inventors: Wan Zhang-Berlinger, Adligenswil (CH); Edit Szocs, Neuchatel (CH); Margit Clauss, Kriens (CH)

(73) Assignee: Rohm and Haas Electronic Materials LLC

( * ) Notice: Subject to any disclaimer, the term of this patent is extended or adjusted under 35 U.S.C. 154(b) by 307 days.

(21) Appl. No.: 13/239,333

(22) Filed: Sep. 21, 2011

(65) Prior Publication Data

US 2012/0067733 A1 Mar. 22, 2012

Related U.S. Application Data

(60) Provisional application No. 61/385,060, filed on Sep. 21, 2010.

(51) Int. Cl.

| | |
|---|---|
| ***C25D 5/10*** | (2006.01) |
| ***C25D 5/12*** | (2006.01) |
| ***C23C 28/00*** | (2006.01) |
| ***C25D 3/46*** | (2006.01) |
| ***C25D 3/50*** | (2006.01) |

(52) U.S. Cl.
CPC .. *C25D 3/46* (2013.01); *C25D 3/50* (2013.01); *C25D 5/10* (2013.01); *C25D 5/12* (2013.01)

(58) Field of Classification Search
CPC ..... C23C 28/023; C25D 3/46; C25D 5/10
USPC ..... 205/170, 181, 191
See application file for complete search history.

(56) References Cited

U.S. PATENT DOCUMENTS

| | | | | |
|---|---|---|---|---|
| 4,055,472 | A * | 10/1977 | Freshcorn | 205/216 |
| 4,126,524 | A * | 11/1978 | Hradil et al. | 205/238 |
| 4,246,077 | A * | 1/1981 | Hradil et al. | 205/238 |
| 4,478,691 | A | 10/1984 | Abys | |
| 5,198,132 | A | 3/1993 | Salomon | |
| 5,601,696 | A * | 2/1997 | Asakawa | 205/263 |
| 6,251,249 | B1 * | 6/2001 | Chevalier et al. | 205/80 |
| 6,998,036 | B2 | 2/2006 | Dietterle et al. | |
| 7,628,903 | B1 | 12/2009 | Tsuji et al. | |
| 2005/0183961 | A1 * | 8/2005 | Morrissey | 205/263 |
| 2007/0151863 | A1 | 7/2007 | Morrissey | |
| 2009/0321269 | A1 | 12/2009 | Tsuji et al. | |
| 2010/0044239 | A1 | 2/2010 | Schafer et al. | |

FOREIGN PATENT DOCUMENTS

| | | | | |
|---|---|---|---|---|
| DE | 101 24 002 | C1 | 2/2003 | |
| EP | 0705919 | A1 | 10/1996 | |
| JP | 11-302893 | | 11/1999 | |
| JP | 2005-105386 | | 4/2005 | |
| RU | 2323276 | C2 * | 4/2008 | C25D 3/46 |
| WO | WO 2005/083156 | A1 | 9/2005 | |

OTHER PUBLICATIONS

Blair, "Silver Plating", Metal Finishing (no month, 2000), vol. 98, No. 1, pp. 298-303.*

Blair, "Silver Plating", Handbook of Physical Vapor Deposition (PVD), pp. 298-303, Metal Finishing, Tarrytown, NY, USA (no month, 2000).

Hungarian Search Report of corresponding Singapore Application No. 201106797-2, no date.

European Search Report of corresponding European Application No. 11 18 2049, no date.

Taiwan Search Report of corresponding Taiwan Patent Application No. 100133877. Correspondence mailed Dec. 24, 2013.

Hawley's Condensed Chemical Dictionary—Fourteenth Edition; John Wiley & Sons, Inc.; 2001; p. 159.

* cited by examiner

*Primary Examiner* — Edna Wong
(74) *Attorney, Agent, or Firm* — John J. Piskorski

(57) ABSTRACT

A silver electroplating solution is used to electroplate a mirror bright silver layer on a nickel or nickel alloy substrate. The silver electroplating solution is cyanide-free and environmentally friendly.

7 Claims, No Drawings

METHOD OF ELECTROPLATING SILVER STRIKE OVER NICKEL

This application claims the benefit of priority under 35 U.S.C. §119(e) to U.S. Provisional Application No. 61/385,060, filed Sep. 21, 2010, the entire contents of which application are incorporated herein by reference.

The present invention is directed to a method of electroplating silver strike over nickel from a cyanide-free silver electroplating solution. More specifically, the present invention is directed to a method of electroplating silver strike over nickel from a cyanide-free silver electroplating solution where an additional silver metal layer plated on the silver strike forms a mirror bright deposit on the nickel.

Silver plating has been conventionally used for decoration and for dinner wares. Owing to its excellent electric characteristics, silver plating has had a wide utility in the electronics industry, such as for switches, connectors and current tracks for photovoltaic devices.

Many conventional silver plating solutions are very toxic because they contain cyanide compounds. In many cases the source of the silver ions of the plating solution is from a water soluble silver cyanide salt. Attempts have been made to reduce or eliminate cyanide compounds from silver plating solutions and at the same time maintain the desired plating performance of the silver plating solutions as well as adhesion of the silver to the substrate and achieve a bright silver deposit. For example, silver nitrate-thiourea solutions and silver iodide-organic acid solutions have been tried but without the success demanded of the industries which readily utilize silver plating solutions. Also, other silver plating solutions have been tried, such as silver solutions containing triethanolamine added to silver thiocyanate solutions and sulfanilic acid deriviatives and potassium iodide added to inorganic and organic acid salts of silver. However, such silver plating solutions have not performed to the satisfaction of the industries which use silver plating solutions.

Cyanide-free silver plating solutions are less toxic to both workers in the industries which use silver electroplating solutions and are more environmentally friendly because waste water from the solutions does not contaminate the environment with cyanide. However, in general, such cyanide-free silver electroplating solutions have not been very stable. The solutions typically decompose during electroplating and the silver ions in the solution are often reduced prior to deposition on the substrate, thus shortening the life of the solutions. There is also room for improvement in the maximum applicable current density as well as the physical properties of the silver deposits.

Nickel undercoat is used as a diffusion barrier between copper substrates and top layers of silver for decorative purposes and electronic applications. Electroplating silver directly onto the nickel, regardless of whether or not the electroplating solution is cyanide-free, results in a silver layer which typically does not adhere well to the nickel. In an attempt to try and address this problem, the industry plates a silver strike layer onto the nickel. This silver strike layer is added to improve adhesion between the subsequent silver layer and the nickel undercoat. The silver strike layer is substantially thinner than the subsequent silver deposit.

U.S. Pat. No. 5,601,696 discloses cyanide-free silver electroplating solutions and methods for depositing silver. The silver plating solution includes silver nitrate and silver oxide as sources of silver and hydantoin compounds as complexing agents. Conductive salts include both potassium chloride and potassium formate. The silver deposits disclosed in the patent are 3.5 μm, 5 μm and 50 μm thick. The patent alleges that it achieves good adhesion between silver and copper substrates; however, the silver deposits from the silver baths which contain chloride or formate are only semi-bright.

Although there is a cyanide-free silver strike electroplating solution which may provide semi-bright silver deposits, there is still a need for a method using cyanide-free silver electroplating solutions which provide a mirror bright silver deposit over nickel or nickel alloy and provides good adhesion between subsequent silver metal deposits and nickel or nickel alloy.

Methods include: a) providing a solution comprising one or more sources of silver ions, one or more imides or imide derivatives, and one or more alkali metal nitrates, the solution is cyanide-free; b) contacting a substrate comprising nickel with the solution; and c) electroplating a silver strike layer onto the nickel or nickel alloy of the substrate. After the initial silver strike layer is deposited onto the nickel or nickel alloy, one or more additional silver layers are deposited onto the silver strike layer to form a mirror bright silver deposit top layer on the nickel containing substrate.

The nitrates in the solution provide for and maintain a mirror bright silver deposit top layer on the nickel or nickel alloy of the substrate. The initial silver strike layer provides good adhesion of additional silver layers deposited on the nickel containing substrate. Further, since the silver electroplating solution is free of cyanide it eliminates the toxic dangers of many conventional silver electroplating solutions and is environmentally friendly. The methods and silver electroplating solutions are used to deposit mirror bright silver layers on nickel containing substrates in decorative applications, electronic applications as well as for photovoltaic applications.

As used throughout this specification, the terms "plating" and "electroplating" are used interchangeably. The indefinite articles "a" and "an" are intended to include both the singular and the plural. The term "silicide" means a binary compound of silicon and another element, usually a metal.

The following abbreviations have the following meanings unless the context clearly indicates otherwise: ° C.=degrees Celsius; g=grams; mL=milliliter; L=liter; A=amperes; dm=decimeter; μm=microns; nm=nanometers; UV=ultraviolet; IR=infrared; ASTM=American Standard Testing Method. All percentages and ratios are by weight unless otherwise indicated. All ranges are inclusive and combinable in any order except where it is logical that such numerical ranges are constrained to add up to 100%.

The methods include the use of aqueous silver strike electroplating solutions containing one or more sources of silver ions. The sources of silver ions include, but are not limited to, silver oxide, silver nitrate, silver sodium thiosulfate, silver gluconate; silver-amino acid complexes such as silver-cysteine complexes; silver alkyl sulfonates, such as silver methane sulfonate and silver hydantoin compound and silver succinimide complexes. Preferably, the sources of silver ions are chosen from silver oxide and one or more silver hydantoin complexes. The silver strike electroplating solutions are free of any cyanide containing silver compounds. The sources of silver ions are included in the strike solutions in amounts of 0.1 g/L to 5 g/L or such as from 0.2 g/L to 2 g/L.

Alkali metal nitrates are included in the aqueous silver strike solution in amounts from 3 g/1 to 30 g/L or such as from 15 g/L to 30 g/L to achieve mirror bright silver top layers. Alkali metal nitrates include sodium nitrate and potassium nitrate.

One or more imides or imide derivatives are included in the silver strike solution in amounts of 40 g/l to 120 g/L, or such as 50 g/L to 100 g/L, or such as from 60 g/l to 80 g/L. Such imides include, but are not limited to, succinimide, 2,2-dimethyl succinimide, 2-methyl 2-ethyl succinimide, 2-methyl succinimde, 2-ethyl succinimde, 1,1,2,2-tetramethyl succinimide, 1,1,2-trimethyl succinimide, 2-butyl succinimide, maleimide, 1-methyl-2-ethyl maleimide, 2-butyl maleimide, 1-methyl-2-ethyl maleimide, pthalimide, pthalimide derivatives, such as N-methyl pthalimide and N-ethyl pthalimide, imide derivatives, such as hydantoin, 1-methylhydantoin, 1,3-dimethylhydantoin, 5,5-dimethylhydantoin, 1-methanol-5,5-dimethylhydantoin and 5,5-diphenylhydantoin.

Sulfamic acid and its salts; alkane sulfonic acids and their salts, such as methane sulfonic acid, ethane sulfonic acid and propane sulfonic acid may be included in the silver strike electroplating solution. Sulfamic acid and its salts and alkane sulfonic acids and their salts may be included in the silver strike solutions in amounts of 5 g/L to 100 g/L or such as from 10 g/L to 60 g/L. Such acids and their salts are generally commercially available from a variety of sources, such as Aldrich Chemical Company, Milwaukee, Wis.

The silver strike electroplating solutions may contain one or more buffering agents. Buffering agents include, but are not limited to, borate buffer, such as borax, phosphate buffer, citrate buffer, carbonate buffer, and sulfamate buffer. The amount of the buffer used is that amount sufficient to maintain a pH of the plating solution at 8 to 14, preferably from 9 to 12.

Optionally one or more surfactants are included in the silver strike solutions. A wide variety of conventional surfactants may be used. Any of anionic, cationic, amphoteric and nonionic conventional surfactants may be used as long as it does not interfere with the performance of the silver plating. Surfactants may be included in conventional amounts known by those of skill in the art for silver electroplating solutions.

Optionally, the silver strike electroplating solutions include one or more additional components. Such additional components include, but are not limited to, grain refiners, anti-tarnish agents, levelers and ductility enhancers. Such additional components are used in conventional amounts and are known to those of skill in the art.

The nickel containing substrate may be electroplated with the silver strike by spraying the silver solution onto the nickel or nickel alloy surface of the substrate using conventional electroplating spray apparatus or by immersing the entire substrate into the silver strike solution. Conventional electroplating apparatus may be used. Electroplating may be done at temperatures ranging from room temperature to 70° C. or such as from 25° C. to 50° C. The nickel containing substrate typically functions as a cathode and any suitable conventional anode for silver electroplating may be used. The anode may be a soluble electrode, such as a soluble silver electrode or insoluble anodes may be used, such as iridium oxide or lead oxide insoluble anodes. The electrodes are connected to a conventional rectifier which provides the source of current. Current density ranges from 0.1 A/dm$^2$ to 2 A/dm$^2$ or such as from 0.2 A/dm$^2$ to 1 A/dm$^2$. Such low current densities in combination with low silver content of 0.1 g/L to 5 g/L provide for a strike film within a plating time of typically 5 seconds to 20 seconds. The silver strike is plated onto the nickel or nickel alloy such that the silver strike layer is directly adjacent the surface of the nickel or nickel alloy. The silver strike plated onto the nickel or nickel alloy ranges in thickness from 0.01 μm to 0.2 μm, or such as from 0.02 μm to 0.1 μm.

Additional silver layers are then deposited onto the silver strike layer such that they are adjacent the silver strike layer to build-up the silver on the nickel substrate to a desired thickness. Such additional silver layers may range in thickness from 1 μm to 50 μm and are mirror bright. Conventional silver electroplating baths may be used for electroplating the additional silver layers onto the silver strike. Although the additional silver layers may be plated from silver electroplating solutions which include cyanide, it is preferable to avoid such electroplating solutions because of their toxic nature and hazard to the environment. The silver layers electroplated onto the silver strike have good adhesion with the underlying nickel and are mirror bright.

The method may be used to provide mirror bright silver deposits wherever mirror bright silver layers are desired. Typically the nickel layer or nickel alloy layer is coated on copper alloys, such as switches, electrical connectors or jewelry. The nickel or nickel alloy layer also may be coated on a polymer material.

The methods for electroplating the silver strike may also be used in the photovoltaic industry in the manufacture of solar cells, such as in the formation of current tracks. In the formation of current tracks, semiconductor wafers are doped to form a p/n junction. Such wafers are typically coated with an antireflective layer of $Si_3N_4$ on the p+ doped emitter layer side of the wafers. Current tracks are then patterned through the antireflective layer exposing the p+ doped emitter layer of the wafer using one or more known conventional etching methods. A nickel seed layer may be deposited on the current tracks of the emitter layer. The nickel seed layer may be deposited by any conventional nickel deposition method known in the art. Typically, the nickel seed layer is deposited by light assisted nickel deposition. If the source of the nickel is an electroless nickel composition, plating is done without application of external current. If the source of the nickel is from an electrolytic nickel composition, a rear side potential (rectifier) is applied to the semiconductor wafer substrate. Current densities may range from 0.1 A/dm$^2$ to 2 A/dm$^2$. Light sources include, but are not limited to, visible light, IR, UV and X-rays.

By illuminating the front of the semiconductor wafer with light energy, plating occurs on the emitter layer. The impinging light energy generates a current in the semiconductor. A nickel layer of 20 nm to 300 nm thickness is typically deposited.

After the nickel seed layer is deposited, a silver strike is immediately deposited adjacent to the nickel. Typically, the silver is deposited in less than one minute after nickel is plated, more typically, less than 30 seconds after nickel plating, most typically from 1 to 30 seconds. If silver is not plated on the nickel within a short time after nickel deposition, the nickel becomes passivated and must be activated prior to silver plating. Passivation is a general term to describe a metal layer which is resistant to plating. When plating does occur on a passivated metal, adhesion between the passivated metal and the metal deposited on it is poor and unreliable. Typically the deposited metal readily peels from the passivated metal. Accordingly, it is highly desirable to deposit the silver on the nickel within one minute or less after nickel plating otherwise an activation step may be required to achieve reliable adhesion between the nickel and the silver.

The silver strike may deposited by light induced plating (LIP) or conventional silver electroplating. In general, the patterned semiconductor wafer is submerged in a silver composition contained in a plating cell. The rear side of the semiconductor wafer is connected to a source of external current (rectifier). A silver anode placed in the silver plating composition is connected to the rectifier such that a completed circuit is formed between the components. Current densities are from 0.1 A/dm$^2$ to 2 A/dm$^2$ or such as from 0.2 A/dm$^2$ to 1 A/dm$^2$.

A light source is positioned to illuminate the semiconductor wafer with light energy. The light source can be, for example, a fluorescent or LED lamp which provides energy within the wavelengths to which the semiconductor wafer is photovoltaically sensitive. A variety of other light sources may be used, such as, but not limited to, incandescent lamps such as a 75 watt and 250 watt lamps, mercury lamps, halogen lamps and a 150 watt IR lamp.

After the silver metal is deposited adjacent the nickel, the semiconductor is then sintered to form nickel silicide. Sintering is done with the silver deposited onto the nickel surface to improve adhesion between the silver and nickel. Sintering with the silver plated onto the nickel increases the window for sintering. In other words, sintering may be prolonged at a given peak temperature over conventional processes to provide improved bonding between the nickel and the silicon without concern for damage to the wafer. In many conventional processes keeping the semiconductor in the oven at a given temperature for too long may cause the nickel to diffuse too deeply into the wafer penetrating the emitter layer thus shunting the wafer. The improved bonding between the nickel and the silicon reduces the probability of adhesion failure between the nickel silicide and the silver. Further, silver is not incorporated into the silicide by the sintering temperatures, thus nickel silicide is formed with the silver protecting the nickel from oxidation during sintering. A furnace providing a wafer peak temperature of 380° C. or greater or from 400° C. to 550° C. may be used. Peak temperatures exceeding 650° C. are not used because at such high temperatures both nickel silicide and nickel disilicide may be formed. The formation of nickel disilicide is undesirable because it has a high contact resistance which reduces current flow in the semiconductor wafer. Typically, peak temperature times range from 2 seconds to 20 seconds. An example of a suitable furnace is a lamp based furnace (IR).

Since the silver layer protects the nickel from oxidation during sintering, sintering may be done in an oxygen containing environment as opposed to an inert gas atmosphere or vacuum. Accordingly, the steps and equipment required in sintering in an inert or vacuum environment are eliminated along with the costly apparatus required for such procedures. Also, the elimination of special inert gases further reduces the cost and complexity of the sintering process. In general, sintering is done for 3 minutes to 10 minutes. Line speeds at which the semiconductor passes through the furnace may vary depending on the furnace used. Minor experimentation may be done to determine the appropriate line speed. Typically, the line speed is from 330 cm/minute to 430 cm/minute.

The methods provide silver strike layers which have good adhesion of additional silver layers deposited on the nickel containing substrate. In addition, the subsequent silver layers plated on the silver strike have a mirror bright finish. Since the silver electroplating solution is free of cyanide it eliminates the toxic dangers of many conventional silver electroplating solutions and is environmentally friendly. The methods and silver electroplating solutions may be used to deposit mirror bright silver layers on nickel containing substrates in decorative applications, electronic applications as well as for photovoltaic applications. They may also be used in the formation of nickel silicides in the formation of current tracks for photovoltaic devices.

The following examples are included to illustrate the invention but are not intended to limit the scope of the invention.

EXAMPLE 1

An aqueous silver strike solution was prepared as shown in the table below.

TABLE 1

| COMPONENT | AMOUNT |
|---|---|
| Silver ions as silver 5,5-dimethyl hydantoin | 1 g/L |
| 5,5-dimethyl hydantoin | 70 g/L |
| Sulfamic acid | 35 g/L |
| Potassium hydroxide | 30 g/L |
| pH | 9.5 |

Six nickel pre-plated copper test panels 50×50 mm were electroplated with the silver strike solution. Each panel was placed in a separate electroplating solution containing the silver strike in Table 1 above. The panels functioned as cathodes and platinised titanium electrodes were used as anodes. The cathodes, silver strike solutions and anodes were joined in electrical communication to a conventional rectifier which provided the current source. Electroplating was done for 20 seconds at a current density of 0.5 A/dm$^2$. A silver strike layer of 0.1 μm thick was deposited on each panel.

After the silver strike was electroplated adjacent the nickel, the silver plated panels were rinsed with deionized water at room temperature. The panels were then electroplated with an additional 5 μm silver layer from a silver electroplating solution containing the components in Table 2 below. Electroplating was done at 5 A/dm$^2$.

TABLE 2

| COMPONENT | AMOUNT |
|---|---|
| Silver ions as silver 5,5-dimethyl hydantoin | 40 g/L |
| 5,5-dimethyl hydantoin | 70 g/L |
| Sulfamic acid | 35 g/L |
| Potassium hydroxide | 30 g/L |
| Grain refiner(s) | 1 g/L |
| pH | 9.5 |
| Temperature | 60° C. |

The silver electroplated panels were rinsed with deionized water at room temperature and air dried. Each silver electroplated panel was then tested for the adhesion of the silver layers to the nickel surface. Adhesion testing was done using the ASTM B571, Scribe-Grid and Tape Test. Tape was applied to the silver layers of each panel and pulled from the panel. None of the tape test samples showed any observable silver deposits on the tape; however, the surface of the silver on all of the panels had dull to milky appearances.

EXAMPLE 2

An aqueous silver strike solution was prepared as shown in the table below.

TABLE 3

| COMPONENT | AMOUNT |
|---|---|
| Silver ions as silver 5,5-dimethyl hydantoin | 1 g/L |
| 5,5-dimethyl hydantoin | 70 g/L |
| Sulfamic acid | 35 g/L |
| Potassium hydroxide | 30 g/L |
| Potassium nitrate | 20 g/L |
| pH | 9.5 |

Six nickel pre-plated copper test panels 50×50 mm were electroplated with the silver strike solution. Each panel was placed in a separate electroplating solution containing the silver strike in Table 3 above. The panels functioned as cathodes and platinised titanium electrodes were used as anodes. The cathodes, silver strike solutions and anodes were joined in electrical communication to a conventional rectifier which provided the current source. Electroplating was done for 20 seconds at a current density of 0.5 A/dm$^2$. A silver strike layer of 0.1 μm thick was deposited on each panel.

After the silver strike was electroplated adjacent the nickel, the silver plated panels were rinsed with deionized water at room temperature. The panels were then electroplated with an additional 5 μm silver layer from a silver electroplating solution as shown in Table 2 in Example 1.

The silver electroplated panels were rinsed with deionized water at room temperature and air dried. Each silver electroplated panel was then tested for the adhesion of the silver layers to the nickel surface. Adhesion testing was done using the ASTM B571, Scribe-Grid and Tape Test. Tape was applied to the silver layers of each panel and pulled from the panel. None of the tape test samples showed any observable silver deposits on the tape. In addition to the good adhesion results, the surface of the silver deposits had mirror bright appearances. This was an improvement over the silver deposits in Example 1 above.

EXAMPLE 3

An aqueous silver strike solution was prepared as shown in the table below.

TABLE 4

| COMPONENT | AMOUNT |
|---|---|
| Silver ions as silver succinimide | 1 g/L |
| Succinimide | 70 g/L |
| Methanesulfonic acid | 2 g/L |
| Potassium hydroxide | Adjust pH to 9.5 |
| Temperature | 25° C. |

Six nickel pre-plated copper test panels 50×50 mm were electroplated with the silver strike solution. Each panel was placed in a separate electroplating solution containing the silver strike in Table 4 above. The panels functioned as cathodes and platinised titanium electrodes were used as anodes. The cathodes, silver strike solutions and anodes were joined in electrical communication to a conventional rectifier which provided the current source. Electroplating was done for 20 seconds at a current density of 0.5 A/dm$^2$. A silver strike layer of 0.1 μm thick was deposited on each nickel panel.

After the silver strike was electroplated adjacent the nickel, the silver plated panels were rinsed with deionized water at room temperature. The panels were then electroplated with an additional 5 μm silver layer from a silver electroplating solution containing silver as silver succinimide. The silver electroplating solution used to plate the additional silver layers included the components in Table 5 below.

TABLE 5

| COMPONENT | AMOUNT |
|---|---|
| Silver ions as silver succinimide | 40 g/L |
| Succinimide | 70 g/L |
| Methanesulfonic acid | 2 g/L |
| Grain refiner(s) | 1 g/L |
| Potassium hydroxide | Adjust pH to 9.5 |
| Temperature | 30° C. |

The silver electroplated panels were rinsed with deionized water at room temperature and air dried. Each silver electroplated panel was then tested for the adhesion of the silver layers to the nickel surface. Adhesion testing was done using the ASTM B571, Scribe-Grid and Tape Test. Tape was applied to the silver layers of each panel and pulled from the panel. None of the tape test samples showed any observable silver deposits on the tape; however, the surface of the silver deposits had dull to milky appearances.

EXAMPLE 4

An aqueous silver strike solution was prepared as shown in the table below.

TABLE 6

| COMPONENT | AMOUNT |
|---|---|
| Silver ions as silver succinimide | 1 g/L |
| Succinimide | 70 g/L |
| Methanesulfonic acid | 2 g/L |
| Potassium hydroxide | 30 g/L |
| Potassium nitrate | 20 g/L |
| pH | 9.5 |

Six nickel pre-plated copper test panels 50×50 mm were electroplated with the silver strike solution. Each panel was placed in a separate electroplating solution containing the silver strike in Table 6 above. The parts functioned as cathodes and platinised titanium electrodes were used as anodes. The cathodes, silver strike solutions and anodes were joined in electrical communication to a conventional rectifier which provided the current source. Electroplating was done for 20 seconds at a current density of 0.5 A/dm$^2$. A silver strike layer of 0.1 μm thick was deposited on each nickel panel.

After the silver strike was electroplated adjacent the nickel, the silver plated panels were rinsed with deionized water at room temperature. The panels were then electroplated with an additional 5 μm silver layer from the silver electroplating solution in Table 5 of Example 3.

The silver electroplated panels were rinsed with deionized water at room temperature and air dried. Each silver electroplated panel was then tested for the adhesion of the silver layers to the nickel surface. Adhesion testing was done using the ASTM B571, Scribe-Grid and Tape Test. Tape was applied to the silver layers of each panel and pulled from the panel. None of the tape test samples showed any observable silver deposits on the tape. In addition to the good adhesion results, the surface of the silver deposits had mirror bright appearances. This was an improvement over the silver deposits in Examples 1 and 3 above.

What is claimed is:

1. A method comprising:

a) providing an aqueous solution consisting of one or more sources of silver ions, one or more imide derivatives chosen from hydantoin, 1-methylhydantoin, 1,3-dimethylhydantoin, 5,5-dimethylhydantoin, 1-methanol-5, 5-dimethylhydantoin and 5,5-diphenylhydantoin, sulfamic acid or salts of sulfamic acid in amounts of 5 g/L to 100 g/L and one or more alkali metal nitrates in amounts of 3 g/L to 30 g/L, and one or more optional components chosen from surfactants, buffers, levelers, anti-tarnish agents and ductility agents, the solution is cyanide-free;

b) contacting a substrate comprising nickel or nickel alloy with the solution;

c) electroplating a silver strike layer 0.01 μm to 0.2 μm thick onto the nickel or nickel alloy of the substrate; and d) electroplating a second silver layer onto the silver strike layer, wherein the one or more alkali metal nitrates of the silver strike layer provide for the second silver layer to have a mirror bright appearance.

2. The method of claim 1, wherein the second silver layer is 1 μm to 50 μm thick.

3. The method of claim 1, wherein the silver strike layer is electroplated at a current density of 0.1 $A/dm^2$ to 2 $A/dm^2$.

4. The method of claim 1, wherein the alkali metal nitrates are potassium nitrate and sodium nitrate.

5. The method of claim 1, wherein the one or more alkali metal nitrates are in amounts of 15 g/L to 30 g/L.

6. The method of claim 1, wherein the one or more sources of silver ions are in amounts of 0.1 g/L to 5 g/L.

7. The method of claim 6, wherein the one or more sources of silver ions are in amounts of 0.2 g/L to 2 g/L.

* * * * *